United States Patent [19]

Kubick

[11] Patent Number: 4,636,799

[45] Date of Patent: Jan. 13, 1987

[54] POLED DOMAIN BEAM SCANNER

[75] Inventor: Frederick Kubick, Redding, Conn.

[73] Assignee: United Technologies Corporation, Hartford, Conn.

[21] Appl. No.: 730,400

[22] Filed: May 3, 1985

[51] Int. Cl.[4] ..... H01Q 3/00; H01Q 15/02; H01Q 15/08

[52] U.S. Cl. ..... 343/754; 343/753; 343/772; 343/909; 350/355

[58] Field of Search ..... 343/753, 754, 772, 909–910, 343/911 R, 911 L; 350/380, 381, 355, 384, 392, 393, 394, 395; 333/21 R, 21 A, 239, 248

[56] References Cited

U.S. PATENT DOCUMENTS

| | | | |
|---|---|---|---|
| 2,591,701 | 4/1952 | Jaffe | 350/389 |
| 2,600,962 | 6/1952 | Billings | 350/372 |
| 2,939,142 | 5/1960 | Fernsler | 343/754 |
| 3,257,608 | 6/1966 | Bell et al. | 350/396 |
| 3,334,958 | 8/1967 | Appeldorn | 350/452 |
| 3,369,242 | 2/1968 | Johnson | 343/754 |
| 3,393,034 | 7/1968 | Imai | 350/260 |
| 3,445,851 | 5/1969 | Sheldon | 343/754 |
| 3,499,701 | 3/1970 | Macek et al. | 350/380 |
| 3,503,670 | 3/1970 | Kosanke et al. | 350/394 |
| 3,507,550 | 4/1970 | Harris et al. | 350/393 |
| 3,513,323 | 5/1970 | Sincerbox et al. | 350/382 |
| 3,522,985 | 8/1970 | Rogers | 350/402 |
| 3,528,723 | 9/1970 | Rogers | 350/403 |
| 3,555,987 | 1/1971 | Browning | 350/384 |
| 3,558,215 | 1/1971 | DeLang et al. | 350/388 |
| 3,574,441 | 4/1971 | Harris et al. | 350/390 |
| 3,575,487 | 4/1971 | Ohm et al. | 350/383 |
| 3,575,488 | 4/1971 | Ohm et al. | 350/383 |
| 3,623,795 | 11/1971 | Taylor et al. | 350/380 |
| 3,631,501 | 12/1971 | Buscher | 343/754 |
| 3,744,875 | 7/1973 | Haertling et al. | 350/389 |
| 3,781,086 | 12/1973 | Kumada et al. | 350/374 |
| 3,809,461 | 5/1974 | Baumgardner et al. | 350/302 |
| 3,868,172 | 2/1975 | Ii et al. | 350/358 |
| 3,938,878 | 2/1976 | Fox | 350/389 |
| 4,129,357 | 12/1978 | Frosch et al. | 350/403 |
| 4,154,505 | 5/1979 | Kato et al. | 350/374 |
| 4,197,008 | 4/1980 | Pinnow et al. | 356/150 |
| 4,201,450 | 5/1980 | Trapani | 350/374 |
| 4,222,638 | 9/1980 | Robert | 350/96.14 |
| 4,229,073 | 10/1980 | Lotspeich | 350/374 |
| 4,327,971 | 5/1982 | Kondo et al. | 350/388 |

OTHER PUBLICATIONS

M. B. Klein, *Dielectric Waveguide Modulators at 95 GHz Using $LiNbO_3$(*)*, International Journal of Infrared and Millimeter Waves, vol. 3, No. 5, (1982).

M. B. Klein, *Phase Shifting at 94 GHz Using the Electro-Optic Effect in Bulk Crystals,* International Journal of Infrared and Millimeter Waves, vol. 2, No. 2 (1981); pp. 239–247.

Cecil E. Land and Philip D. Thacher, *Ferroelectric Ceramic Electrooptic Materials and Devices,* Proceedings of the IEEE, vol. 57, No. 5 May 1969; pp. 751–758.

*Primary Examiner*—Marvin L. Nussbaum

*Attorney, Agent, or Firm*—Robert P. Sabath

[57] ABSTRACT

A scanner (13) of ferroelectric material (17) for redirecting a beam (22) of millimeter wavelength radiation. The scanner (13) includes parallel input and output sides with matching layers (44). Adjacent and opposite parallel wire grid electrodes (31') are addressed with opposite sense voltage pulses in order to redirect the domain orientation of crystals in selected regions of said ferroelectric material (17).

5 Claims, 12 Drawing Figures

POLED DOMAIN BEAM SCANNER

DESCRIPTION

1. Technical Field

The invention herein deals with the technology of radars and more particularly the application of ferroelectric materials and their electro-optic properties to beam scanning in radar systems, especially those operating at millimeter wavelengths.

2. Background Art

Ferroelectric materials have become well known since the discovery of Rochelle salt for their properties of spontaneous polarization and hysteresis. See the *International Dictionary of Physics and Electronics,* D. Van Nostrand Company Inc., Princeton (1956). Other ferroelectrics including barium titanate have also become familiar subjects of research.

However, the application of the properties of ferroelectric materials to millimeter wavelength devices and radar systems is largely uncharted scientific terrain, especially with respect to scanning devices.

At millimeter wavelengths, moreover, standard microwave practice is hampered by the small dimensions of the working components, such as waveguides and resonant structures. Furthermore, there is a considerable lack of suitable materials from which to make components. Even beyond this, the manufacturing precision demanded by the small dimensions of the components, makes their construction difficult and expensive.

Ferroelectric materials are accordingly of particular interest in making scanning devices, because certain of their dielectric properties change under the influence of an electric field. In particular, an "electro-optic" effect can be produced by the application of a suitable electric field. Furthermore, field-induced ferroelectric domain orientation and reorientation is possible with these materials.

As is well known, ferroelectric materials are substances having a non-zero electric dipole moment in the absence of an applied electric field. They are frequently regarded as spontaneously polarized materials for this reason. Many of their properties are analogous to those of ferromagnetic materials, although the molecular mechanism involved has been shown to be different. Nonetheless, the division of the spontaneous polarization into distinct domains is an example of a property exhibited by both ferromagnetic and ferroelectric materials.

A suitably oriented birefringent medium modifies the character of passing radiation in several ways. For example, an electric field may change the birefringence of the medium, thereby altering the propagation conditions of the medium. This change can result from a shift in the direction of the optic axis, as would result from domain reorientation.

The change in propagation conditions due to domain reorientation can be understood as follows. Radiation in the millimeter wavelength domain divides into two components upon incidence with a ferroelectric medium having a suitably aligned optic axis. One component exhibits polarization which is perpendicular to the optic axis (the ordinary ray), and the other component exhibits polarization orthogonal to that of the first, and is parallel to the optic axis (the extraordinary ray). The refractive indices of the birefringent material, respectively $n_o$ and $n_e$, determine the different speeds of propagation of the two components.

These characteristics of ferroelectric materials can be utilized to contribute to the effective operation of ferroelectric or poled domain scanners in order to electronically control the direction of millimeter wavelength propagation in certain kinds of radar systems, as will be shown.

In particular, the propagation of such radiation through such ferroelectric media can be electrically controlled, because of the domain structure of the medium. In particular, as will be seen, the domain alignments within the ferroelectric material can be changed by the pulsed application of a directed electric field upon the selected portions of the medium.

BRIEF DESCRIPTION OF THE INVENTION

According to the invention addressed herein, a highly anisotropic, monolithic block of ferroelectric material is disposed in the path of a beam of millimeter wavelength radiation. A pair of wire grid electrodes straddle opposite sides of the ferroelectric material. The electrodes are effective for inducing a spatially varying phase shift in the passing millimeter wavelength radiation by means of gradually aligning or poling the optic axes of successive domain groups across the face of the ferroelectric material, between axial and transverse disposition thereof. As a result, the controllable alteration of the direction of the beam of radiation is accomplished. A phase shift to redirect the beam is produced by the change in the relationship of the passing wave with respect to the propagation constants of the ferroelectric medium.

According to the invention, the steering of a millimeter wavelength radar beam over a significant angular range is thus performed electronically.

DETAILED DESCRIPTION OF A PREFERRED MODE

Figure 1:
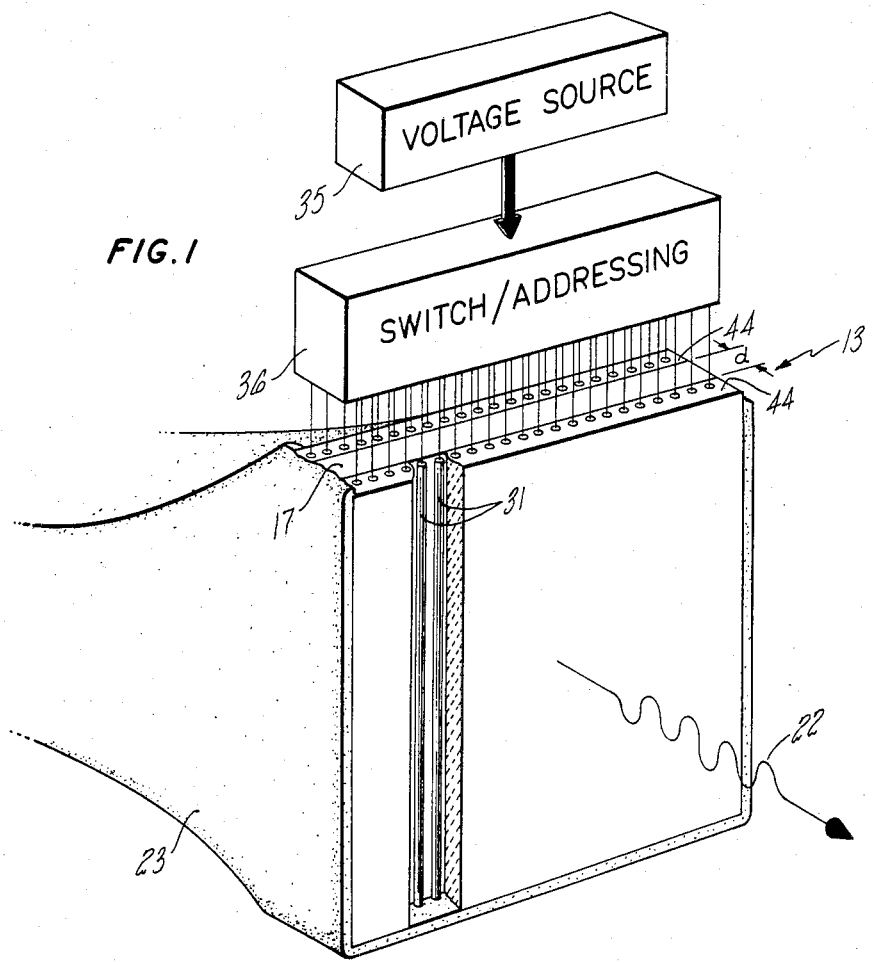
FIG. 1 is an isometric view of a monolithic block of ferroelectric material including matching layers and straddling grid electrodes in accordance with the invention herein.

FIG. 1 shows the basic configuration of a beam scanner 13 according to the invention herein for diverting the direction of a beam 22 of millimeter wavelength radiation produced in horn 23. The scanner 13 includes an active medium such as for example a monolithic block of highly anisotropic ferroelectric material 17 such as, for example, barium titanate, barium strontium titanate or lead titanate in fine-grained random polycrystalline or ceramic form, for insertion over a horn 23 or other aperture of a radar system (not shown). In fact, Perovskite materials in general are suitable candidates for application to this invention. The ferroelectric material 17 intercepts the beam 22 of millimeter wavelength electromagnetic radiation for redirection as will be shown. In particular, the ferroelectric material 17 is distributed over the aperture of horn 23 in the form of a planar layer of substantially uniform thickness "d". According to one version of the invention, the ferroelectric material 17 is rectangular in form.

On each side of the ferroelectric material 17, there are disposed independently addressable parallel wires 31 in the form of a grid 31' which serve as oppositely disposed and straddling pairs of electrodes for a pulsed electric field to be applied in order selectively to align the optic axes of different domain groups of material 17 with respect to the radiation propagation direction. During operation, as will be seen, the wires 31 in these grid electrodes 31' are group-wise excited by voltage source 35 operating through a well-known switch addressing scheme 36. This permits one-dimensional or lengthwise variations in the field profile applied across the mouth of horn 23. The induced phase shifts thus established cause the radar beam 22 to establish a phase cancellation scheme effective to change direction in a manner to be described. In principle, the operation of the scanner is thus similar to that of phased array radar antennas.

The scanner 13 further includes two impedance matching layers 44 on opposite sides of the ferroelectric material 17, which in effect thereby straddle the ferroelectric material 17. These layers reduce the reflective losses which would otherwise impede performance, in view of the very high refractive indices characterizing ferroelectric materials, as is well known. The matching layers 44 are suitably deposited, for example, upon the flat surfaces of the ferroelectric material 17 by well known vacuum deposit techniques, for example, or by cementing or pressing into place prefabricated thin layers or sheets of a suitable dielectric material which is effective for proper matching of the input and output sides of the ferroelectric material 17. In lieu of a single matching layer 44, several layers can be substituted. If different kinds of dielectric material are used, as is well known, the device bandwidth can be enhanced.

Figures 2A, 2B, 2C:
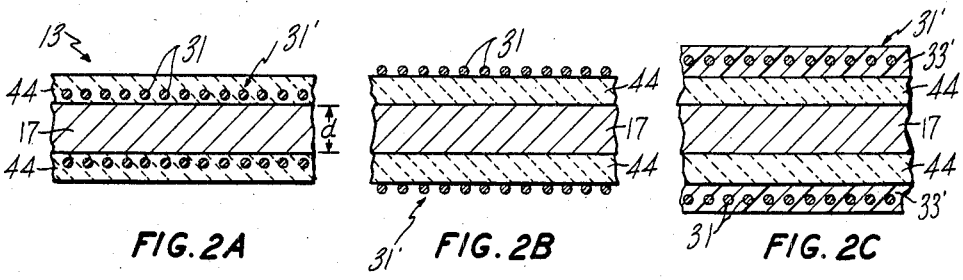
FIGS. 2A–2C respectively are partial cross sections of three variations for carrying out the invention, FIG. 2A thereof indicating the grid wires immediately adjacent the ferroelectric material, FIG. 2B showing the grid wires outside both of the matching layers of the ferroelectric material, and FIG. 2C showing the grid wires relatively far removed from the ferroelectric material.
Figure 3A:
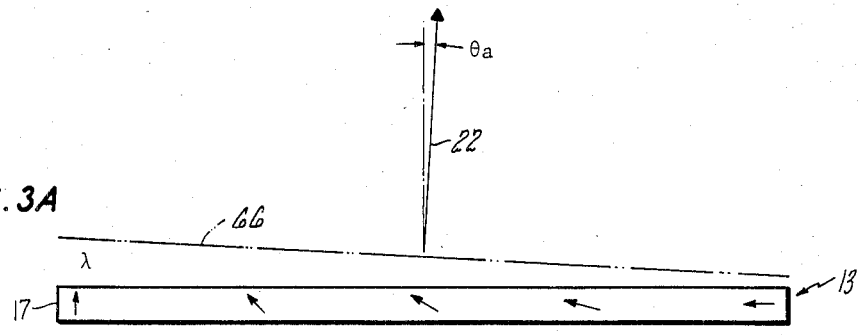
FIGS. 3A–3D show redirected wave fronts of millimeter wavelength radiation in which the ferroelectric material is poled respectively to establish a single continuous wave front, a discontinuous wave front with two transition zones, a discontinuous wave front with four transition zones, and a discontinuous wave front with six transition zones.
Figure 3B:
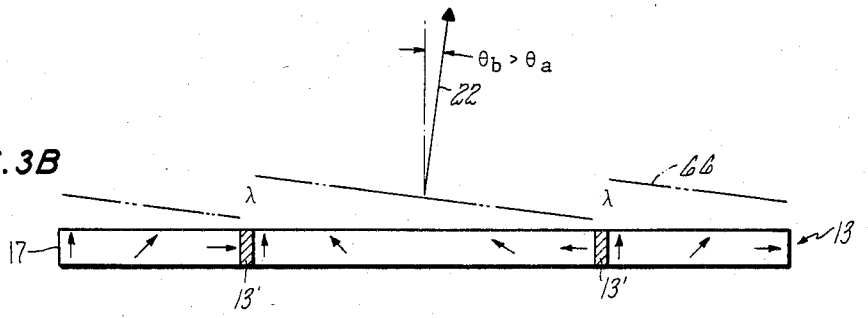
Figure 3C:
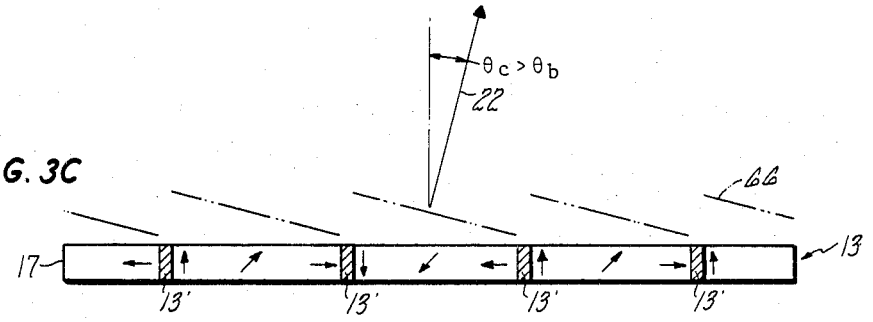
Figure 3D:
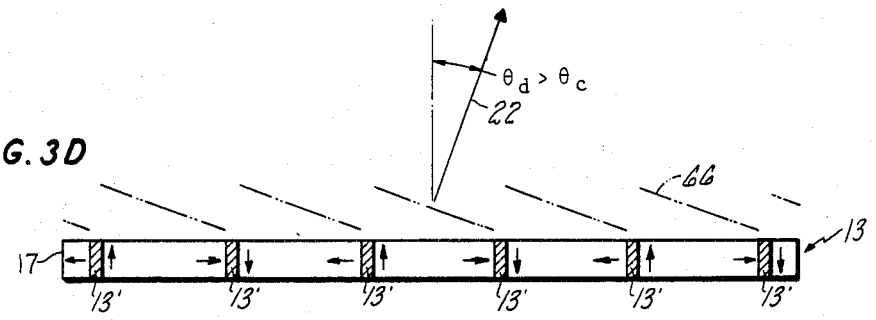

The wire electrodes 31 may be situated somewhat removed from the impedance matching layers as suggested in FIG. 2C. In this case, they may for example be held in a mechanical frame or in a low index epoxy 33'. Alternatively, the electrodes 31 can be positioned immediately adjacent to the impedance matching layers 44 as FIG. 2B shows. The electrodes 31 can even be placed almost immediately adjacent to the ferroelectric material 17 as shown in FIG. 2A. The selected one of these versions of the invention, i.e. the version performing most favorably for a particular application, depends upon the nature of the field profile, fringing effects and the interaction between grid reflections. One way to apply the wires 31 is by well known vacuum deposit techniques such as evaporative deposition or sputtering for example.

This arrangement conducts beam steering of passing radiation 22 by inducing a differential phase shift in the radiation 22 as it passes through the active portion of the ferroelectric material 17.

The beam steering process results from a controlled phase shift distribution created by selectively aligning the ferroelectric domains across the face of and through the bulk of the monolithic block of ferroelectric material 17. In order for this process to work, the ferroelectric material 17 must be highly anisotropic and it must be formed as a fine-grained random poly-crystalline material (ceramic).

In order to redirect the beam of radiation 22, an electric field distribution is generated between pairs of wires 31, according to a selected scheme to be discussed below. The electric field levels established are of sufficient magnitude (20 kV/cm for example) to cause the ferroelectric domains of material 17 to align preferentially along the field lines established by the various pairs of wires 31 cooperating with each other.

This process of alignment is called poling, because it causes individual crystals of material 17, which are normally not preferentially aligned throughout the material, to switch discretely to another one of the available configurations permitted by its crystal lattice structure. Because of the randomness of the polycrystalline form, the average domain alignment of material 17 is generally randomly directed prior to poling.

Poling can align the optic axis of portions of material 17 adjacent wires 31 in accordance with the poling potentials applied to these wires 31. If poling is conducted in a manner such that the material domains align perpendicularly to the plane of the scanner aperture, then the optic axes will be parallel to the direction of beam 22 propagation, and the wave velocity of beam 22 will be determined by the so-called ordinary refractive index "$n_o$". If the material domains are pointed parallel to the aperture plane, and also perpendicular to the grid wires, then an orthogonally polarized wave will travel through material 17 at the speed determined by the extraordinary refractive index "$n_e$". If the poling occurs in any other direction, the refractive index of the medium as seen by the radiation will lie between "$n_o$" and "$n_e$". For some ferroelectrics the difference between "$n_o$" and "$n_e$" can be quite substantial, resulting in a large selection of refractive index values.

Poling is conducted in a manner designed to avoid the possibility of any cumulative voltage buildup across the aperture. Thus, the voltage excitation pulse applied to two or more wire pairs is applied in succession, until the entire active medium is poled in the desired manner.

After the poling is completed, the direction of the optic axis in material 17 varies progressively across the aperture of horn 23 according to a preferred version of the invention, resulting in the progressively changing phase shift induced in the traversing beam 22 of millimeter wavelength radiation.

Because the upper bound on the induced phase shift is determined by the difference "$n_o$" − "$n_e$", the maximum steering angle is limited in magnitude. However, increased steering angles can be established by forming segmented wave zones as suggested in FIGS. 3A–3D. The only requirement is that the phase shift upper bound be at least two pi radians (phase shift plus or minus pi) and this therefore establishes a basic requirement for the active material.

A significant feature of this invention is the placement of ferroelectric material 17 between a series of wire electrodes 31 which can induce a spatially varying phase shift in throughward traversing millimeter wavelength radiation 22 by selectively poling the ferroelectric domains of material 17, and thereby altering the direction of radiating beam 22. This is done by establishing a spatially varying phase shift in the radiation beam 22 as it passes through material 17. This phase shift is produced by varying the orientation of the optic axis with respect to the direction of the passing radiation.

To reduce the effects of field fringing, the wires 31 are spaced apart at distances less than a wavelength of radiation 22. For a scanner having an aperture of M wavelengths with half-wavelength wire spacing, a total of 2M wire pairs, each of them independently excitable, would thus be required.

Because an upper bound is placed on the induced phase shift by the difference between $n_o$ and $n_e$, the maximum steerage which can be applied to beam 22 with a single zone embodiment of the invention is limited. However, larger scan angles can be achieved by stepping the phase by two pi radians or one wavelength, whenever the required nominal phase shift exceeds its bounds.

This procedure results in the creation of additional zones 13″ which become progressively smaller as the scan angle increases. In other words, the poling scheme repeats itself across each zone 13″ on the face of the aperture.

It is required in implementing multiple adjacent zones 13″, however, that the phase shift established between adjacent zones be at least two pi radians (a phase shift plus or minus two pi) in order to avoid destructive intererence bewteen the output from adjacent zones, as is well-known.

In particular, gradually to pole a selected zone 13″ on the face of material 17 to steer a first maximum beam direction, a first portion or end of a zone of the material may, for example, be poled downward; then, successive adjacent regions of the material 17 are gradually diagonally poled in a progressively more rotated direction until the domain of a final portion of the material is completely sidewardly poled—either to the right or to the left. Instead of initally downwardly poling the first section, it could in the alternative also be upwardly poled to accomplish the same effect or purpose. Thus the poling on one end of each zone 13″ is orthogonal or transverse to the poling on the other end of the zone 13″.

Such poling is accomplished with respect to the first zone 13″, for example by pulsing oppositely disposed ones of wires 31 at one end of the zone 13″ with a sufficient level of opposite polarity voltage to pole the first portion downwardly.

Alternatively, pairs of adjacent wires 31 on the same side of material 17 can be provided with the same polarity voltage pulse while those wires 31 on the opposite side of material 17 are concurrently oppositely pulsed. Thereby, a broader first region of material 17 is downwardly poled than if only two opposite wires 31 are oppositely pulsed. However, in any case, for downward poling, at least a pair of oppositely disposed cooperative wires 31, such as for example 31(1), and 31(2) must be pulsed with a sufficient voltage difference.

To accomplish sideward poling, adjacent wires 31, rather than opposite wires, are oppositely pulsed. For rightward poling, the adjacent wires 31 are pulsed according to one sense of polarity, and for leftward poling, the adjacent wires are pulsed in the opposite sense of polarity.

A preferred version of the invention calls for wires 31 to act in groups of four or more to conduct effective poling in the sideward or transverse direction. For example, first a selected pair of wires 31 are positively pulsed with a sufficient voltage level while concurrently the adjacent wires on opposite side of the material 17 are negatively pulsed. A next group of two or four wires 31 can be diagonally pulsed to establish a skewed or diagonal orientation for the poling axis.

Figure 4A:
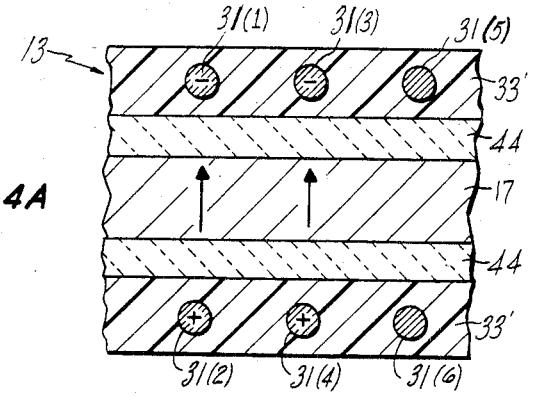
FIGS. 4A–4D respectively show portions of the ferroelectric material straddled by a number of grid electrodes to accomplish upward, diagonal, rightward and gradual poling of the crystal domains in the ferroelectric material indicated.

In particular, FIG. 4A for example shows upward poling by negatively pulsing wire electrodes 31(1) and 31(3), while positively pulsing electrodes 31(2) and 31(4).

Figure 4B:
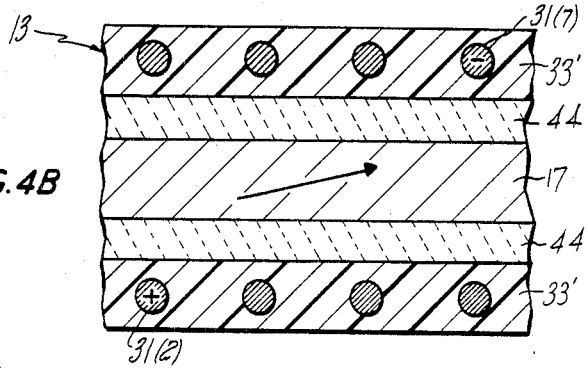

FIG. 4B in turn shows one way how to diagonally pole the ferroelectric material 13 by applying opposite sense voltage pulses to skewed electrodes respectively 31(2) and 31(7). Diagonal poling may also be accomplished with adjacent electrode pairs.

Figure 4C:
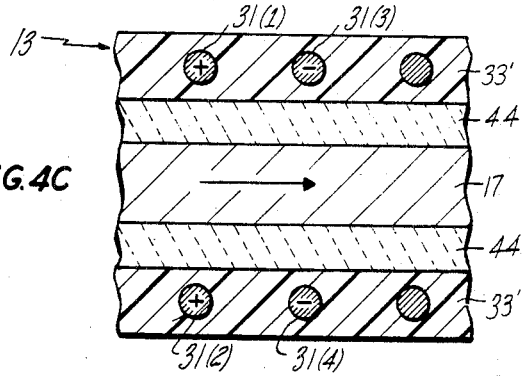

FIG. 4C shows how to sideward pole the domain of the ferroelectric material.

Figure 4D:
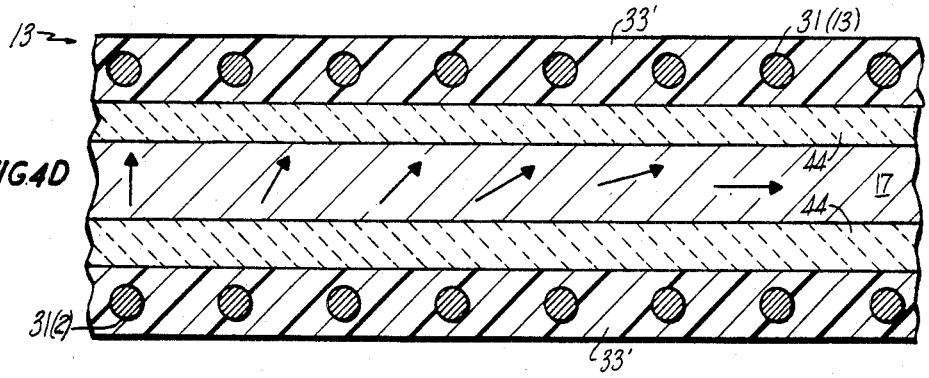

Finally, FIG. 4D shows the accomplishment of a gradual poling scheme according to the invention herein. This is accomplished in steps. Adjacent portions of the ferroelectric material are preferably not simultaneously poled, according to a preferred version of the invention. Instead, discrete portions of the material 13 are each independently poled, as suggested in the partial cross sections of FIGS. 4A–4C.

By repeated poling of adjacent and/or overlapping groups of four wires 31, the poling orientation can run a portion of a period, an entire period, a period and a fraction thereof, or several periods, depending upon the desired redirection of the beam 22 of radiation.

The scanner 13 is inherently wave polarization selective, both because of the wire grid electrodes 31, and also because of the domain structure.

Reflections caused by the traversal of the millimeter wavelength radiation into and out of the ferroelectric material 17 are eliminated by suitable impedance matching layers disposed adjacent the input and output sides of the ferroelectric material 17. A radar scanner 13 of the above indicated construction is particularly compact and very fast in scanning operation.

By way of additional detail, each of said parallel wire electrodes includes a plurality of parallel wires, and thus in effect can be said to constitue an electrode grid. The control means for the grid and for individual one of the wires is the switching and addressing scheme 36 in FIG. 1. This scheme 36 permits each one of the wires 31 to be independently addressed with a selected voltage level derived from voltage source 35 according to well known electrical techniques.

Moreover, highly anisotropic materials are considered to be those in which the ordinary index of refraction "$n_o$" is much greater than the extraordinary index "$n_e$" or in which "$n_e$" is much less than "$n_o$". This property is found in certain ferroelectric ceramics, e.g. Perovskites, and including for example barium titanate, barium strontium titanate, strontium titanate materials or mixtures.

Regarding conventions used herein, transverse generally means orthogonal, which in turn means perpendicular. Further, wires and electrodes herein are considered to be electrically conductive.

The information detailed above may lead others skilled in the art to conceive of variations thereof, which nonetheless fall within the scope of this invention. Accordingly, attention is directed toward the claims which follow, as these set forth the metes and bounds of the invention with particularity.

I claim:

1. A millimeter wavelength scanner in the path of millimeter wavelength radiation for modifying the direction of a beam of millimeter wavelength radiation passing therethrough and comprising a block of ferroelectric material with parallel input and output sides with respect to the path of said millimeter wavelength radiation and said block of ferroelectric material including first and second matching layers on respectively said input and output sides;

characterized in that said block of ferroelectric material is monolithic and in that said millimeter wavelength scanner further comprises electrode means for progressively varying the distribution of domain orientations in at least a single predetermined zone of said block of ferroelectric material, said electrode means being generally perpendicular to the direction of propagation of said millimeter wavelength radiation and said electrode means further including first and second corresponding pluralities of independently addressable parallel wires, each of said wires and said first and second pluralities thereof being parallel to each other, each of said predetermined zones including corresponding pluralities of adjacent ones of said parallel wires on opposite sides of said block of ferroelectric material, the wires on one end of each of said zones acting in groups of at least two oppositely disposed wires subject to a predetermined pulsed voltage difference therebetween for establishing a first poling direction in said block of ferroelectric material which coincides generally with the direction of propagation of said millimeter wavelength radiation, the wires on the opposite end of each of said zones acting in groups of at least four wires including two wires on one side of said block and corresponding two wires on the other side of said block of ferroelectric material, the two wires of the group of four on the first side of the block being subject to a predetermined potential difference aligned in a direction generally transverse to the direction of propagation, and the corresponding two wires on the other side being subject to the same potential difference, thereby establishing a second poling direction in said block of ferroelectric material which is transverse to the direction of said millimeter wavelength radiation, and the intermediate wires of each zone cooperating in diagonal groups of at least two wires, one of the two intermediate wires being on one side of said block of ferroelectric material and the other of said intermediate wires being on the opposite side thereof, said at least two intermediate wires being subject to a predetermined voltage difference therebetween to establish a range of intermediate poling directions for the intermediate regions of each zone, which progressively range from said first poling direction along the general direction of said beam of millimeter wavelength radiation to said second poling direction orthogonal thereto, whereby a distribution of progressively varying domain orientations in selected zones of said block of ferroelectric material is established in order to steer said beam of millimeter wavelength radiation.

2. The scanner of claim 1, further characterized in that the poling direction at the end of one zone in said block of ferroelectric material is transverse to the poling direction at the adjacent end of a next immediately adjacent zone thereof.

3. The scanner of claim 1, further characterized in that said ferroelectric material is barium titanate.

4. The scanner according to claim 1, further characterized in that said parallel wires are disposed within said corresponding matching layers.

5. The scanner according to claim 1, further characterized in that said parallel wire electrodes are disposed outward of said respective matching layers.

* * * * *